US005729908A

United States Patent [19]

Braden

[11] Patent Number: 5,729,908

[45] Date of Patent: Mar. 24, 1998

[54] BOOT DRYING APPARATUS

[76] Inventor: Larry Dean Braden, 917 W. 18th St., Cheyenne, Wyo. 82001

[21] Appl. No.: 31,264

[22] Filed: Mar. 15, 1993

[51] Int. Cl.[6] ..... F26B 25/00

[52] U.S. Cl. ..... 34/104; 34/437; 34/439; 34/440; 34/441; 392/360; 392/379; 392/380; 392/382

[58] Field of Search ..... 34/104, 437, 439, 34/440, 441; 392/360, 379, 380, 382

[56] References Cited

U.S. PATENT DOCUMENTS 3,154,392 10/1964 Littman .
3,645,009 2/1972 Ketchum .
5,287,636 2/1994 Lafleur et al. ..... 34/104

*Primary Examiner*—Henry A. Bennet
*Assistant Examiner*—Siddharth Ohri

[57] ABSTRACT

An apparatus for the enhanced drying of shoes and boots is provided, having a main housing cylinder having a first end cap secured to a main housing, with a fan motor and screen directing forced air into a heated grid of the main housing cylinder, with the main housing cylinder including directing conduits, with the directing conduits arranged for receiving L-shaped tubes for insertion within boots, and wherein the organization is arranged for disassembly for securing the L-shaped conduits within the main housing during transport and storage of the organization.

3 Claims, 5 Drawing Sheets

BOOT DRYING APPARATUS

BACKGROUND OF THE INVENTION

1. Field of the Invention

The field of invention relates to boot and shoe drying apparatus, and more particularly pertains to a new and improved boot drying apparatus wherein the same is arranged for the enhanced drying of boots and shoes by directing forced air within such shoe components.

2. Description of the Prior Art

Boot and shoe drying structure is available in the prior art and exemplified by various patents such as U.S. Pat. Nos. 4,198,765; 3,867,611; 4,903,957; and 5,016,364.

The instant invention attempts to overcome deficiencies of the prior art by providing for an organization easily transported and stored, as well as of efficient and compact construction in a manner not addressed by the prior art and in this respect, the present invention substantially fulfills this need.

SUMMARY OF THE INVENTION

In view of the foregoing disadvantages inherent in the known types of shoe drying apparatus now present in the prior art, the present invention provides a boot drying apparatus wherein the same is arranged for mounting relative to boot and shoe members for enhanced drying within such boot and shoe cavities. As such, the general purpose of the present invention, which will be described subsequently in greater detail, is to provide a new and improved boot drying apparatus which has all the advantages of the prior art boot drying apparatus and none of the disadvantages.

To attain this, the present invention provides an apparatus for the enhanced drying of shoes and boots, having a main housing cylinder having a first end cap secured to the end of the main housing, with a fan motor and screen directing forced air into a heated grid of the main housing cylinder, with the main housing cylinder including directing conduits, with the directing conduits arranged for receiving L-shaped tubes for insertion within boots, and wherein the organization is arranged for disassembly for securing the L-shaped conduits within the main housing during transport and storage of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boot drying apparatus which has all the advantages of the prior art boot drying apparatus and none of the disadvantages.

It is another object of the present invention to provide a new and improved boot drying apparatus which may be easily and efficiently manufactured and marketed.

It is a further object of the present invention to provide a new and improved boot drying apparatus which is of a durable and reliable construction.

An even further object of the present invention is to provide a new and improved boot drying apparatus which is susceptible of a low cost of manufacture with regard to both materials and labor, and which accordingly is then susceptible of low prices of sale to the consuming public, thereby making such boot drying apparatus economically available to the buying public.

Still yet another object of the present invention is to provide a new and improved boot drying apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
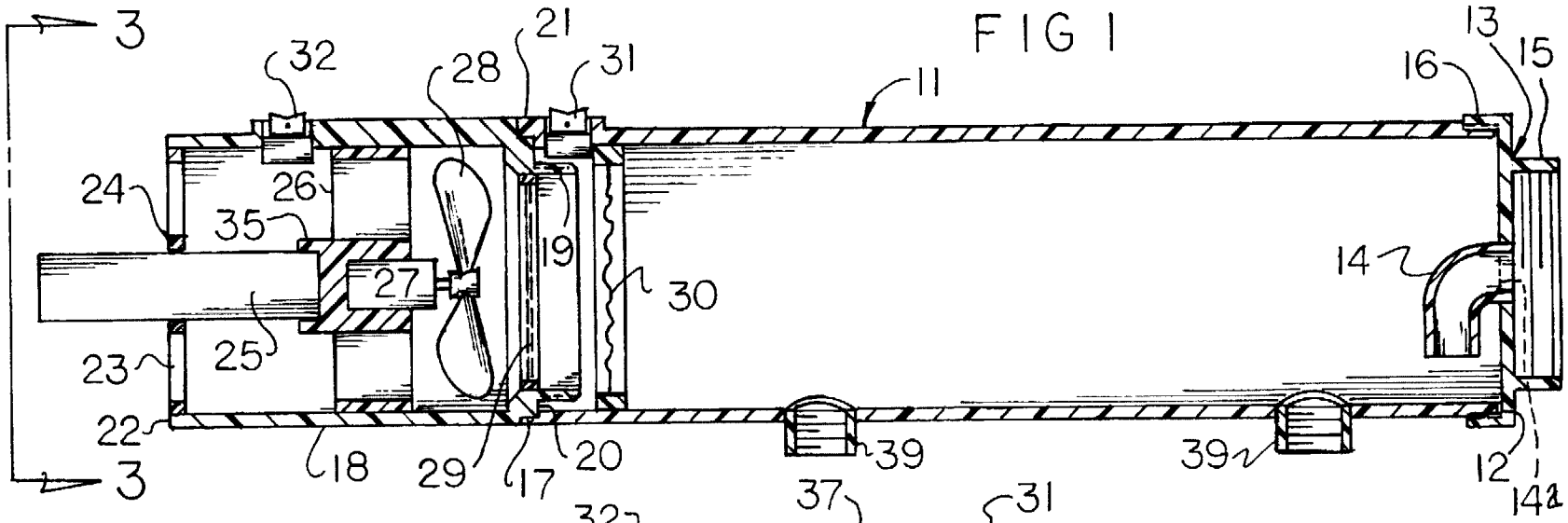
FIG. 1 is an orthographic cross-sectional illustration of the invention.

With reference now to the drawings, and in particular to FIGS. 1 to 12 thereof, a new and improved boot drying apparatus embodying the principles and concepts of the present invention and generally designated by the reference numeral 10 will be described.

More specifically, the boot drying apparatus 10 of the instant invention essentially comprises a housing tube 11 having a tube first end 12 spaced from a tube second end 17. The tube first end 12 mounts a first end cap 13 removably therefrom. A first end cap skirt 16 of said first diameter is mounted to the first side of the first end cap for securement to the housing tube first end 12. A fan motor 27 having impellers 28 to project pressurized air through a filter screen 29 receiving air through end cap 13 and directs such air into the housing tube 11 past an electrical resistance heating grid 30 operative through a heating grid on/off switch 31. The fan motor is operative through a fan motor on/off switch 32. The fan motor is mounted within a resilient ring within the cap 13 as illustrated.

A plurality of housing tube coupling conduits 39 are directed into the housing tube 11 between the housing tube first end 12 and the housing tube second end 17. These conduits 39 are arranged for orientation into shoe members (not shown).

A twelve volt adapter plug 42 is arranged for positioning within a typical vehicular cigarette lighter for utilization of the organization within a self-propelled vehicle.

Figure 3:
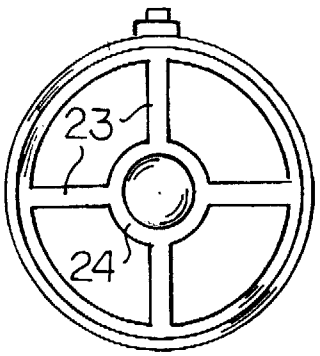
FIG. 3 is an orthographic view, taken along the lines 3—3 of FIG. 1 in the direction indicated by the arrows.
Figure 2:
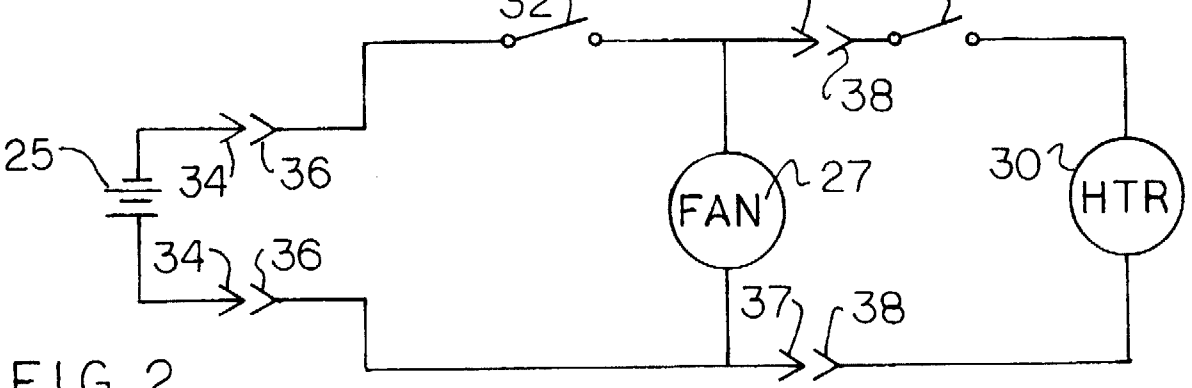
FIG. 2 is a diagrammatic electrical circuitry typically employed by the invention.
Figure 4:
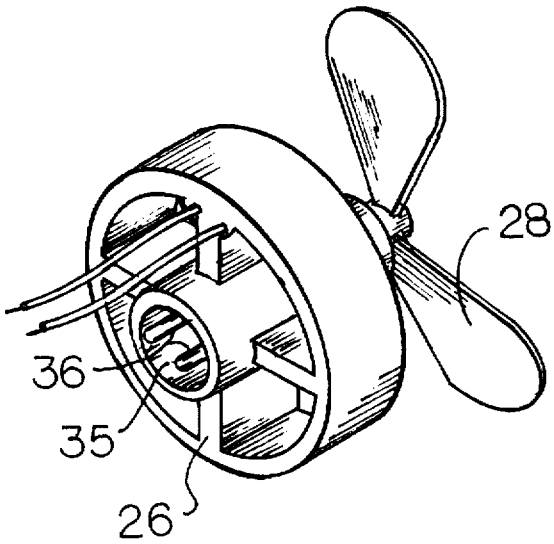
FIG. 4 is an isometric illustration of the fan motor portion of the invention.
Figure 5:
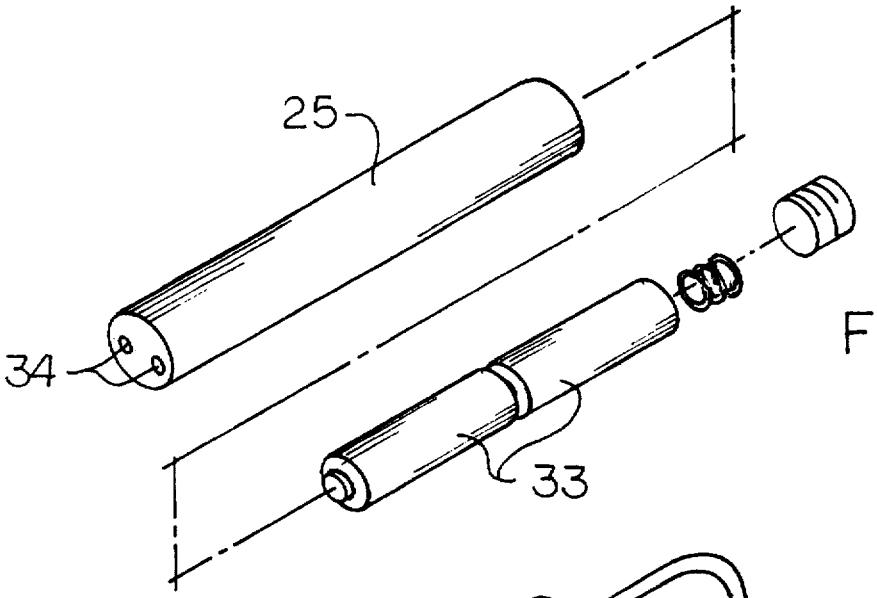
FIG. 5 is an isometric illustration of the battery cylinder structure of the invention.

The FIGS. 3–5 indicates the use of an optional ten volt to twelve volt adapter housing structure, wherein a twelve plug receptacle 48 is directed into the adapter housing 43, with the adapter housing 43 (in lieu of a conventional AC plug) having spaced parallel legs 44, with each leg having an arcuate recess 45, with the arcuate recesses 45 coaxially aligned for receiving the housing tube 11 thereon. If desired, an adapter housing second end wall 49 relative to the first end wall 47 is arranged to include a battery charger cavity 50.

Figure 6:
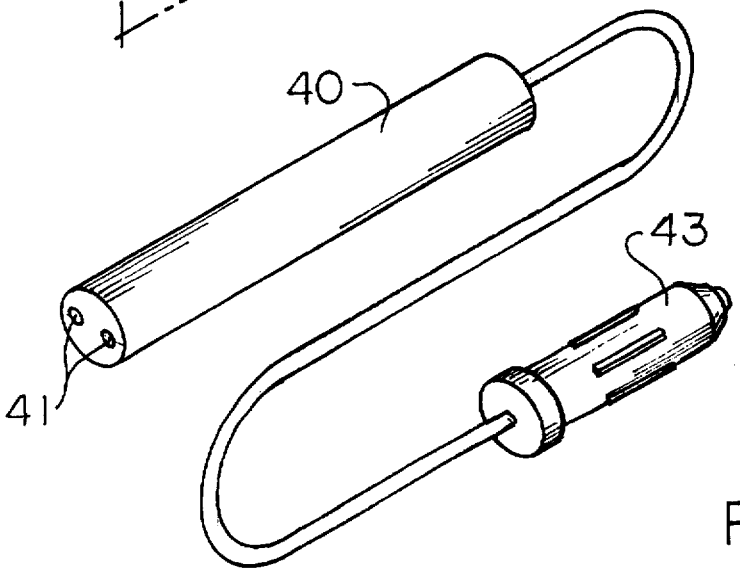
FIG. 6 is an isometric illustration of the twelve volt adapter structure utilized by the invention.
Figure 7:
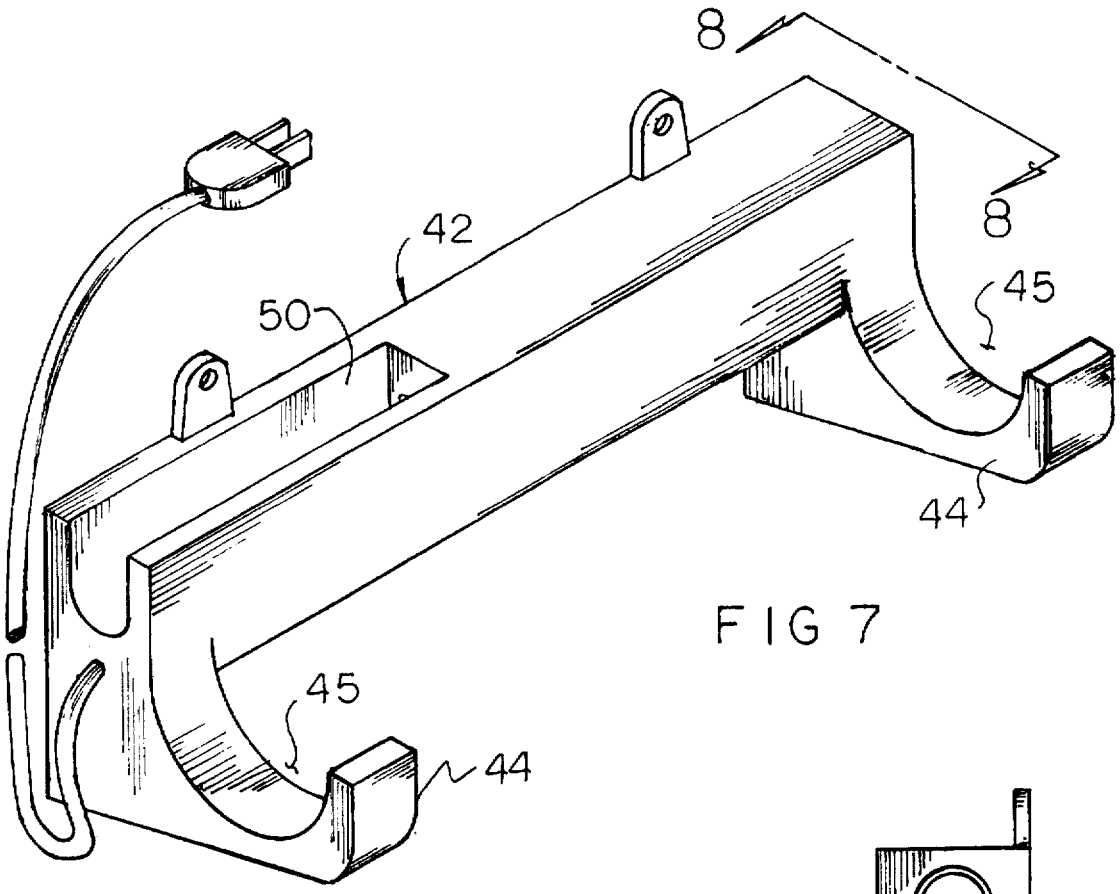
FIG. 7 is an isometric illustration of a further voltage adapter structure utilized by the invention.
Figure 8:
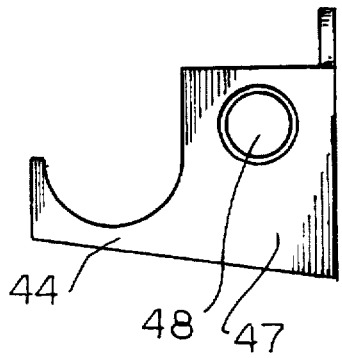
FIG. 8 is an orthographic view, taken along the lines 8—8 of FIG. 7 in the direction indicated by the arrows
Figure 9:
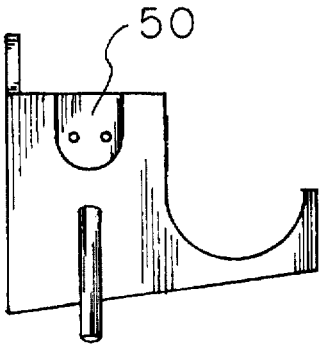
FIG. 9 is an orthographic end view of the adapter structure opposed to FIG. 8.
Figures 10, 11:
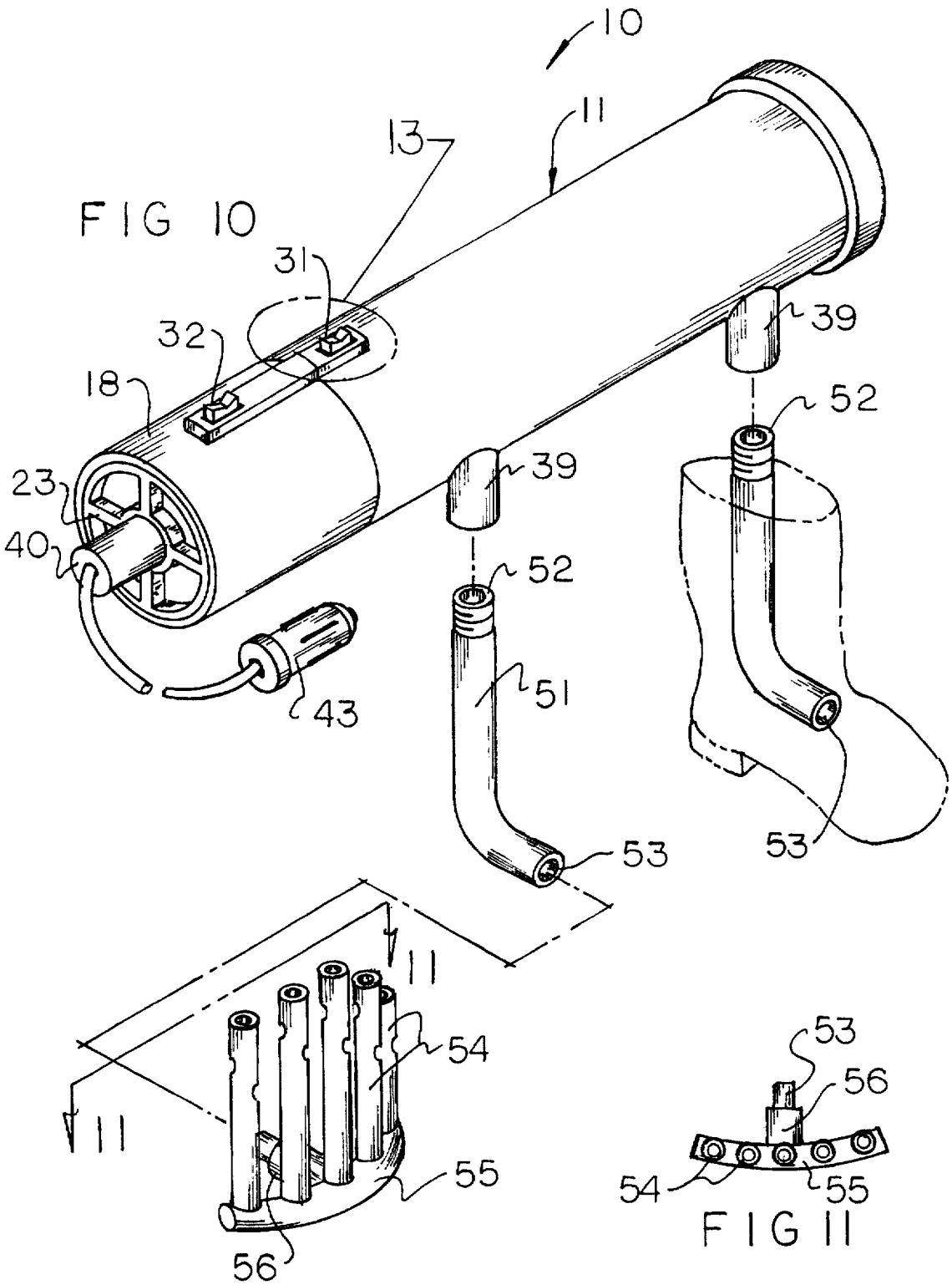
FIG. 10 is an isometric illustration of the invention in an assembled configuration.
FIG. 11 is an orthographic view, taken along the lines 11—11 of FIG. 10 in the direction indicated by the arrows.
Figure 12:
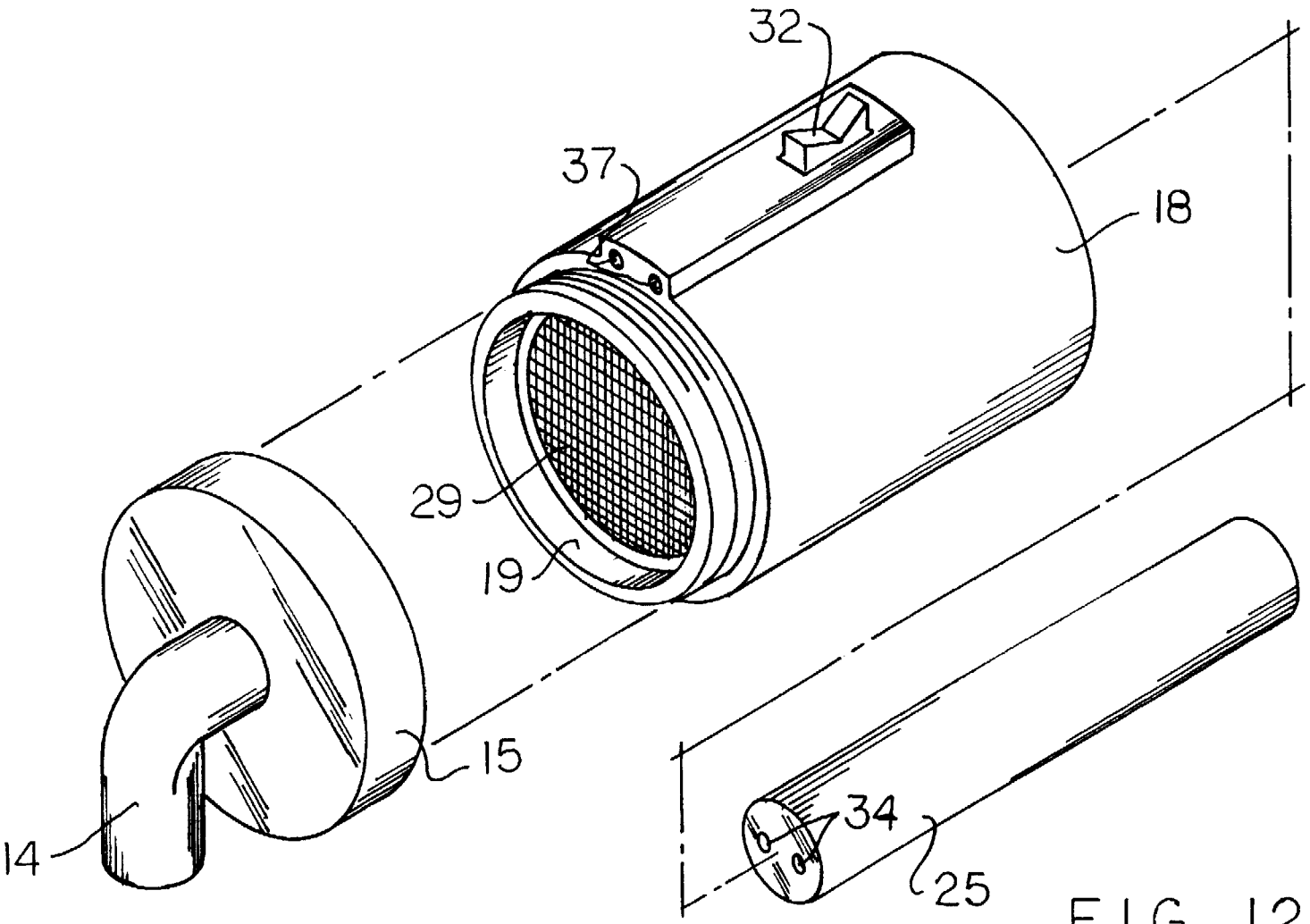
FIG. 12 is an isometric illustration of the organization employing only the second tube structure in a drying procedure.

The FIG. 6 indicates the use of L-shape boot conduits 51 for projection into boot members, as indicated in phantom in FIG. 10, with each L-shaped boot conduit 51 having a boot conduit fastener first end 52 arranged for securement to one of the housing tube coupling conduits 39. The boot conduit second end 53 is arranged for projection into the boot, as indicated in FIG. 6, or alternatively for reception within a mounting tube 56 that in turn is in pneumatic communication into a conduit manifold 55. The conduit manifold includes a plurality of parallel apertured glove conduits 54 for positioning a glove over the glove conduits for the use of the organization in the drying of individual glove members of conventional construction (not shown).

The FIGS. 9–12 indicates a modified construction of the invention arranged for positioning within a shoe in sealed relationship relative to the inlet of the shoe, wherein the housing 60 includes an outlet port 61 to direct air into the shoe through the screen 67 by use of the fan motor 65 operative through batteries 64 and an on/off switch 63. A removable battery door 66 provides access for maintenance of the batteries when replacement is required. An outer channel cavity 68 receives air such as dampened air from within the shoe and as the dampened air is not released through the inlet of the shoe as the housing 60 is in sealed relationship thereto, the dampened air is directed into the channel cavity 68 in adjacency to the housing 60 for venting of the air through the vent ports 62 in communication with the channel cavity 68. In this manner, individual shoes are afforded drying by a simplified and expedient construction as indicated in the Figures as noted.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings arid described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted falling within the scope of the invention.

What is claimed as being new and desired to be protected by Letters Patent of the United States is as follows:

1. A boot drying apparatus, comprising, a housing tube, the housing tube having a first diameter and having a housing tube first end spaced from a housing tube second end, and a housing tube first end cap securable to the housing tube first end, a fan and resilient mounting means for medially securing the fan motor thereof, the resilient mounting means securing the fan motor adjacent to the tube second end; the resilient mounting means further having support vents mounted at the second end, the support vents including a cylindrical fan motor housing operatively secured to the fan motor and coaxially aligned within a resilient mounting ring, and the fan motor having fan motor impellers, and the housing tube having a housing tube electrical resistance heating grid mounted in adjacency to the fan motor, and an on/off switch arranged for effecting electrical communication between the heating grid and a second on/off switch mounted to the tube for effecting electrical communication between the fan motor.

2. An apparatus as set forth in claim 1 including a plurality of L-shaped boot conduits, each L-shaped boot conduit including a fastener first end for securement to one of said coupling conduits, and a boot conduit second end.

3. An apparatus as set forth in claim 2 including at least one glove drying mandrel, wherein the at least one glove drying mandrel includes a plurality of parallel apertured glove conduits, and a conduit manifold, the conduit manifold in pneumatic communication with the glove conduits, and a mounting tube in pneumatic communication with the conduit manifold, the mounting tube arranged for receiving the boot conduit second end therewithin.

* * * * *